United States Patent [19]

Watkins et al.

[11] Patent Number: 4,874,442

[45] Date of Patent: Oct. 17, 1989

[54] METHOD FOR APPLYING STRAND FILLING COMPOUND

[75] Inventors: Clinton E. Watkins; Bobby A. Rowland, both of Carroll County, Ga.

[73] Assignee: Southwire Company, Carrollton, Ga.

[21] Appl. No.: 91,810

[22] Filed: Sep. 1, 1987

[51] Int. Cl.[4] ..... H01B 13/14

[52] U.S. Cl. ..... 156/48; 156/148; 156/244.12; 264/174; 427/120

[58] Field of Search ..... 156/48, 244.12, 148; 264/174; 427/117, 120

[56] References Cited

U.S. PATENT DOCUMENTS

| | | | |
|---|---|---|---|
| 3,218,207 | 11/1965 | Iafrate et al. | 156/48 |
| 3,607,487 | 9/1971 | Biskeborn et al. | 156/48 X |
| 3,849,354 | 11/1974 | Strecker et al. | 156/48 X |
| 3,889,455 | 6/1975 | Portinari et al. | 156/48 X |
| 4,033,800 | 7/1977 | Ollis | 156/48 |
| 4,105,485 | 8/1978 | Portinari et al. | 156/383 |
| 4,129,466 | 12/1978 | Portinari et al. | 156/48 |
| 4,273,597 | 6/1981 | Garner et al. | 156/48 |
| 4,419,157 | 12/1983 | Ferrentino | 156/48 X |
| 4,435,613 | 3/1984 | Gaubert | 156/48 X |
| 4,563,540 | 1/1986 | Bohannon et al. | 174/23 R |
| 4,568,400 | 2/1986 | Patterson et al. | 156/48 |

*Primary Examiner*—Robert A. Dawson

*Attorney, Agent, or Firm*—Stanley L. Tate; James W. Wallis, Jr.

[57] ABSTRACT

A method and apparatus for the application of moisture blocking compound to the interstitial spaces of a stranded conductor. The application of the compound is accomplished through the use of a cone die which regulates the amount of compound applied to the conductor.

11 Claims, 2 Drawing Sheets

METHOD FOR APPLYING STRAND FILLING COMPOUND

TECHNICAL FIELD

This invention relates to an improved method for the application of a strand filling compound to a stranded conductor. More particularly, it relates to a method for the application of a strand filling compound to a stranded conductor as said conductor is being fabricated by utilizing a cone shaped die.

BACKGROUND ART

Concentric lay stranded conductors are well known within the electrical industry. Such conductors are customarily fabricated by stranding together a plurality of wires in concentric layers. The natural geometry of such a construction is that when round wires of the same diameter are used to form a stranded conductor, six wires fit around a single core wire, twelve wires fit around the layer of six wires, eighteen wires fit around the layer of twelve wires and so on with each successive layer containing six wires more than are contained in the layer around which they are being stranded. The number of individual wires contained in any conductor having "n" layers of wire and being so constructed is calculated by the algebraic equation $X=3n^2+3n+1$ where "X" represents the number of wires forming the conductor and "n" represents the number of layers being stranded about the central wire. The spaces between the individual wires are known as interstitial spaces and these spaces are inherent in conductors so manufactured.

One of the drawbacks with this type of conductor is the tendency for water and moisture to migrate throughout the length of the conductor by following these interstitial spacings. Attempts to prevent the flow of water or moisture, should it be introduced into such a conductor, have been made in many forms. Early attempts to solve the problem consisted of sealing the ends of the conductor at the point where it was joined to another conductor or at the point where it was terminated. A proper seal at the end of the length of the stranded conductor does indeed prevent moisture and/or water from flowing back into the conductor, however, problems with moisture in the conductor usually occur not from moisture or water entering the conductor through the end, but typically when moisture or water is allowed to enter the stranded structure through a flaw in the insulation or damage to the insulation which results in a hole in the insulating jacket of the conductor.

Other attempts to minimize the flow of moisture or water within the interstitial spaces of the stranded conductor came in the form of compacted or compressed stranded conductors. The stranded conductor itself was radially crushed in order to reduce the diameter of the conductor and to fill the interstitial spacing with metal from the individual wires themselves. The drawback to this method of blocking moisture is that even though some deformation of the individual wires does take place, and some of the interstitial spacing is filled, there is still substantial space present through which moisture and water will traverse.

A natural step toward correcting the problem of moisture flowing within this interstitial space consisted of filling the interstitial space with a foreign substance which physically prevented the flow of the moisture or water within the conductor structure. These compounds typically comprised some type of jelly base and a polyethylene filler material. At slightly elevated temperatures, this compound becomes fluid and viscous and can be applied to the stranded conductor as the conductor is being formed. The individual wires used to form the conductor are fed into an extrusion die where the moisture blocking compound is extruded onto and around each individual wire and, as the wires are stranded into the conductor, the interstitial space is filled with the jelly-like material. Upon cooling, the filler becomes very stable and immobile and does not tend to flow out of the interstitial spaces of the stranded conductor. That is to say, once the filling compound is applied within the interstitial spaces of the stranded conductor, it tends to remain in place. The problems encountered in applying such a filling compound revolve around precise metering of the compound into the interstitial spaces as the stranded conductor is being formed. If too much material is extruded into the conductor, the outer insulation will not fit properly. If too little compound is applied, the interstitial spaces will not be filled and therefore will allow moisture to flow within the conductor.

Another drawback to this method of applying the moisture blocking compound is that an extrusion head and an extrusion pump for applying the compound is required for every individual layer of wires used to form the concentric lay conductor. A seven strand conductor requires one extrusion pump and extrusion head. The second layer which forms a thirteen strand conductor requires an additional extrusion pump and extrusion head. The third layer which forms a nineteen strand conductor requires a third pump and extrusion head, and so on. The problems described above regarding the regulation of the volume of compound applied through an extrusion head are multiplied every time an additional extrusion pump and extrusion head is required within the conductor manufacturing system. Efforts to manufacture an acceptable moisture blocked conductor revolve around methods for uniform application of the moisture blocking compound to the concentric lay conductor.

Applications of moisture blocking compound to the interstitial spacing of concentric lay conductors is known within the industry. Evidence of this can be found in U.S. Pat. Nos. 3,607,487; 3,889,455; 4,105,485; 4,129,466; 4,435,613; 4,563,540; and 4,273,597.

U.S. Pat. No. 4,273,597 shows a method of strand filling. This invention deals with filling the interstitial spacing of a conductor not with a jelly-like substance as described above, but with a powder. This is accomplished by passing the strands through a fluidized powder bed, where the interstitial spacing is filled with the powder. The stranded conductor then exits the opposite end of the bed where an insulating layer is applied which prevents the powder from vacating the interstitial spacing of the conductor.

U.S. Pat. No. 4,563,540 describes a waterproof conductor which is constructed by flooding a waterproofing material among the individual conductors which make up the core of the stranded conductor. This flooded core is then wrapped with a plurality of different layers of shielding material which prevents the influx of moisture into the stranded conductor.

U.S. Pat. No. 4,435,613 describes an undersea conductor for transporting electrical power. This conductor is constructed of a plurality of layers of insulating material, with the core (or conducting portion) of the conductor being filled with an insulating layer of polyethylene. This polyethylene layer is contained by other rubber and plastic and epoxy compounds which produce a conductor having a waterproof construction.

U.S. Pat. No. 4,129,466 deals with a method for the application of the filling medium which is applied to a stranded conductor. This method comprises a chamber into which are passed individual wires that will be used to form the stranded conductor. These wires have a filling medium applied to them in the chamber. After the application of this filling medium, the conductor is passed through a chilling chamber where the filling medium is cooled and allowed to gel within the interstitial spaces. This method requires that the chamber containing the filling compound and the stranded conductor be both heated and pressurized. The heat applied to the chamber reduces the viscosity of the filling material, while the pressure assures introduction of the compound into the interstitial spaces of the stranded conductor.

U.S. Pat. No. 4,105,485 deals with the apparatus utilized in the '466 method patent previously discussed.

U.S. Pat. No. 3,889,455 deals with a method and apparatus for filling the interstitial spacing of the stranded conductor in a high temperature flooding tank. In this invention, the individual wires are fed into a tank containing the filling compound, the compound having been heated to allow it to become more viscous. The individual wires are actually stranded and closed within the confines of the flooding tank and the finished conductor is withdrawn from the opposite end of the flooding tank where it is passed through a cooling means. The disadvantages experienced here involve the practice of stranding the conductor beneath the surface of an elevated temperature moisture block pool. No access, either visual or mechanical, to the conductor manufacturing process is practical.

U.S. Pat. No. 3,607,487 provides a method whereby individual strands of wire are fed into a flooding tank which is supplied with heated filling compound by a pump and an injection means. The stranded conductor is withdrawn through the opposite end of the flooding tank and is wiped in a wiping die. The conductor is then wrapped in a core wrapper. The wrapped core is then passed through a binder where it is bound. The bound, wrapped core is then passed through a cooler which sets the gel. The above described process is repeated through another flooding tank, another cooler, another binding machine, another flooding tank, another extruder, another cooling trough, and is eventually withdrawn from the end of the manufacturing line as a product having a plurality of layers of moisture blocking compound which protects the conductor core of the conductor. The disadvantages here comprise a complex manufacturing line whereby moisture blocking compound is applied at three different locations, each location having to be meticulously monitored and controlled in order for a proper conductor construction to be obtained.

It can be readily seen from the above referenced methods and apparatuses that moisture blocked conductor is known and is being manufactured in the industry today. It can also be recognized that there are major problems concerning the uniform application of the moisture blocking compound during the fabrication of the stranded conductor.

DISCLOSURE OF THE INVENTION

Accordingly, it is an object of the present invention to provide a method whereby a uniform volume of moisture blocking compound may be applied to a concentric lay conductor as the conductor is being formed.

Another object of the present invention is to provide a method and apparatus through which a concentric lay conductor may be formed which has the precise volume of moisture blocking compound applied such that the interstitial spacing of the stranded conductor is filled and the proper amount of compound is applied to the outside of the stranded conductor being formed, such that when a subsequent layer of wires is applied, the interstices so formed will be filled substantially completely as said subsequent layer of wire is being applied.

Still another object of the present invention is to reduce the number of mechanical pumps and extrusion heads required to apply moisture blocking compound to a concentric lay conductor.

Yet another object of the present invention is to provide a method and apparatus that is simple in its operation so as to allow uniform operation in a commercial setting from work shift to work shift and from one machine operator to another.

A principle feature of the present invention is the elimination of some pumps and extrusion crossheads in the process for manufacturing a strand filled conductor.

Another feature of the present invention is the provision of a method whereby a conductor comprising nineteen strands may be properly filled with moisture blocking compound with a single pass through a single applicator die.

An important feature of the present invention is the simplicity of its operation in that there are very few adjustments that can be made by an individual machine operator.

An important feature of the present invention is the provision of a die whereby the exit diameter of said die determines the volume of moisture blocking compound applied to a given conductor being pulled there through.

Another feature of the present invention is the absence of any closed chambers which must be maintained with constant pressures or flow rates.

One advantage of the present invention is the ability to produce a strand filled, nineteen wire, concentric lay conductor with a single pass through a single applicator die.

Another advantage of the present invention is the uniformity of the product produced, due in part to the absence of adjustments that need be made to the applicator die by the machine operator.

Still another advantage of the present invention is the ability to predetermine the volume of moisture blocking compound that will be applied to the stranded conductor.

And a further advantage of the present invention is the minimum maintenance required in order for the applicator die to function properly.

And still a further advantage of the present invention is the ability to change the diameter of the exit die by simply changing a standard die insert in the core die itself.

Although the present invention has been discussed and described with primary emphasis on one preferred embodiment, it should be obvious that adaptations and modifications can be made which would produce similar end results on larger conductors without departing from the spirit and scope of this invention.

BEST MODE FOR CARRYING OUT THE INVENTION

Figure 1:
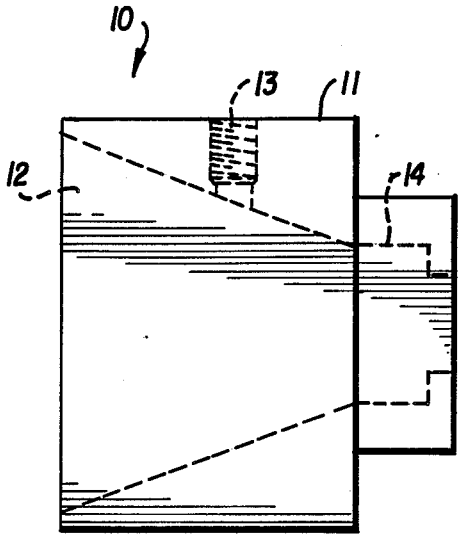
FIG. 1 is a cross sectional view of the applicator cone die illustrating its major components.

Refer now to FIG. 1, which is a cross sectional view of the present invention illustrating the major functional components which comprise the cone die (10). Cone die (10) is the apparatus of the present invention used to apply the strand filling material to the stranded conductor.

Cone die (10) comprises: a substantially cylindrical body (11), a tapered axial bore (12), a threaded passage (13) connecting the surface of cylindrical body (11) and the tapered axial bore (12), and a chamber (14) at the exit end of said cylindrical body for containment of a standard stranding die (not shown).

Figure 2:
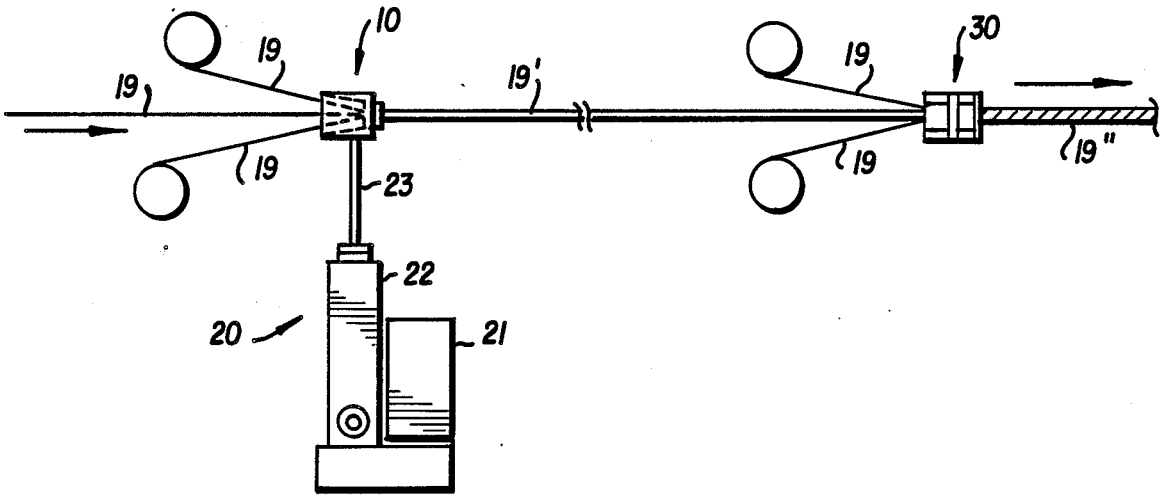
FIG. 2 is a cross sectional view of a typical setup utilizing the cone die of FIG. 1.

Refer now to FIG. 2, which is a general schematic of the present invention showing the general components of the complete system for applying the moisture blocking strand filling compound to a stranded conductor.

Individual wires (19) enter into and are guided by cone die (10) where they are loosely stranded and form loosely stranded conductor (19'). Loosely stranded conductor (19') passes through closing block (30) where additional layers of individual wire (19) are stranded onto loosely stranded conductor (19') and the entire assembly is closed by closing block (30) to form finished strand filled conductor (19''), which is collected by a collecting means (not shown).

Moisture blocking compound contained in tank (21) is forced by pump (22) through channel (23), which cooperates with passage (13) [See FIG. 1], into axial bore (12). As wires (19) are twisted within axial bore (12) of cone die (10), said wires collect moisture blocking compound contained within said bore and wires (19) and moisture blocking compound are both pulled through axial bore (12). The product which exits cone die (10) through standard stranding die (not shown) is a loosely stranded conductor (19') which contains a predetermined volume of moisture blocking compound. When loosely stranded conductor (9') enters closing block (30) and additional individual wires (19) are added thereto, the entire assembly is passed through closing block (30) with the product exiting closing block (30) being a finished strand filled conductor (19'') which has been treated with the moisture blocking compound in a quantity sufficient to fill all interstitial spaces within said stranded conductor (19'').

What is claimed is:

1. Method for application of moisture blocking compound to the interstitial spaces of a stranded conductor, comprising:

feeding a plurality of electrical wires into a cone die;

applying a moisture blocking compound to the individual strands of wire;

passing said plurality of strands of wire and said moisture blocking compound through an exit die;

loosely stranding said plurality of wires together;

passing said loosely stranded conductor through closing blocks; and collecting said stranded conductor.

2. The method according to claim 1, wherein a concentric lay conductor is formed from seven individual wires.

3. The method according to claim 1, wherein moisture blocking compound is applied to the individual wires in said cone die.

4. The method according to claim 1, wherein the seven individual wires having been coated with moisture blocking compound are set in a standard closing block.

5. The method according to claim 4, wherein a layer of twelve strands of wire is subsequently applied about the concentric lay seven wire core, and this assembly of wires is passed through a closing block.

6. The method according to claim 3, wherein moisture blocking compound is supplied to said cone die by an extruder.

7. The method of claim 6, wherein moisture blocking compound is preheated.

8. The method according to claim 3, wherein the amount of moisture blocking compound applied is controlled by the exit diameter of said cone die.

9. The method according to claim 8, wherein the amount of moisture blocking compound applied is such that when the loose strands are fixed in said closing block, the interstitial spaces of the stranded cable are substantially completely filled.

10. The method according to claim 1, wherein said exit die is replaceable.

11. The method according to claim 10, wherein said exit die is a standard drawing die.

* * * * *